United States Patent [19]

Langley

[11] 4,451,203

[45] May 29, 1984

[54] TURBOMACHINE ROTOR BLADE FIXINGS

[75] Inventor: Kenneth R. Langley, Wotton-under-Edge, England

[73] Assignee: Rolls Royce Limited, London, England

[21] Appl. No.: 357,220

[22] Filed: Mar. 11, 1982

[30] Foreign Application Priority Data

Apr. 29, 1981 [GB] United Kingdom ..... 8113277

[51] Int. Cl.[3] ..... F04D 12/01; F01D 5/32

[52] U.S. Cl. ..... 416/215; 416/220 R; 416/218

[58] Field of Search ..... 416/215, 220, 221, 198 A, 416/218

[56] References Cited

U.S. PATENT DOCUMENTS

| | | | |
|---|---|---|---|
| 2,683,018 | 7/1954 | Schorner | 416/218 |
| 3,045,968 | 7/1962 | Willis | 416/220 |
| 3,165,294 | 1/1965 | Anderson | 416/220 |
| 3,572,966 | 4/1971 | Borden et al. | 416/95 |
| 4,021,138 | 5/1977 | Scalzo et al. | 416/220 |

FOREIGN PATENT DOCUMENTS

| | | | |
|---|---|---|---|
| 375539 | 5/1923 | Fed. Rep. of Germany . | |
| 1134472 | 12/1957 | Fed. Rep. of Germany | 416/216 |
| 590433 | 7/1947 | United Kingdom . | |
| 928349 | 6/1963 | United Kingdom | 416/220 |
| 2001708 | 2/1979 | United Kingdom . | |

*Primary Examiner*—Stephen Marcus
*Assistant Examiner*—Brian J. Bowman
*Attorney, Agent, or Firm*—Parkhurst & Oliff

[57] ABSTRACT

A dovetail type circumferential slot fixing for retaining blades of a bladed rotor assembly of a turbomachine which requires no additional loading slot. The shape and dimensions of the dovetail roots of the blades and the dovetail blade-retaining slot are such as to allow the blades to be loaded by introducing a flank of each root dovetail into the slot and rolling the blades in an axial direction. The blades are held outwards against radially inward facing faces of the blade-retaining slot by a support means which may be a detachable plate, flange member or nose bullet that engages the blade platforms.

22 Claims, 3 Drawing Figures

TURBOMACHINE ROTOR BLADE FIXINGS

This invention relates to bladed rotor assemblies, such as compressors or turbines of turbomachines.

There are many ways of securing aerofoil blades to rotor hubs of turbomachines. The present invention is concerned with the type of fixing which employs a circumferentially extending dovetail slot in which blades with a dovetail shaped root are located. Such a type of fixing is described, for example, in British Pat. No. 1,187,227.

There are numerous problems associated with circumferential slot fixings but such fixings are cheaper and easier to produce and also save weight compared with other types of fixing.

Prior known circumferential slot fixings have suffered from the problems associated with the need to provide a loading slot that penetrates the flanks of the dovetail slot and through which each blade must be inserted.

Once inserted each blade must be indexed around the slot and the final blade must be retained either by providing an additional retaining clip or by arranging that all the blades are shuffled to bring two blades into offset relationship with the loading slot. Also the feeding slot requires to be closed off to prevent gas leakages into the circumferential slot.

Another problem in providing a feeding slot is that the feeding slot is usually located in regions of high stress and the stress concentrations due to the presence of the feeding slot may be unacceptable. Furthermore for a first stage of a fan or LP compressor, that may be subject to damage due to impacts by foreign objects, the relative strength of the circumferential slot fixings cannot be exploited fully because of the severe limitations imposed by the need to use narrow width roots to enable them to be inserted through the loading slot.

The present invention as claimed overcomes the above mentioned problems by proposing a circumferential slot fixing which does not require a loading or feeding slot.

The present invention will now be described by way of an example in which.

Figure 1:
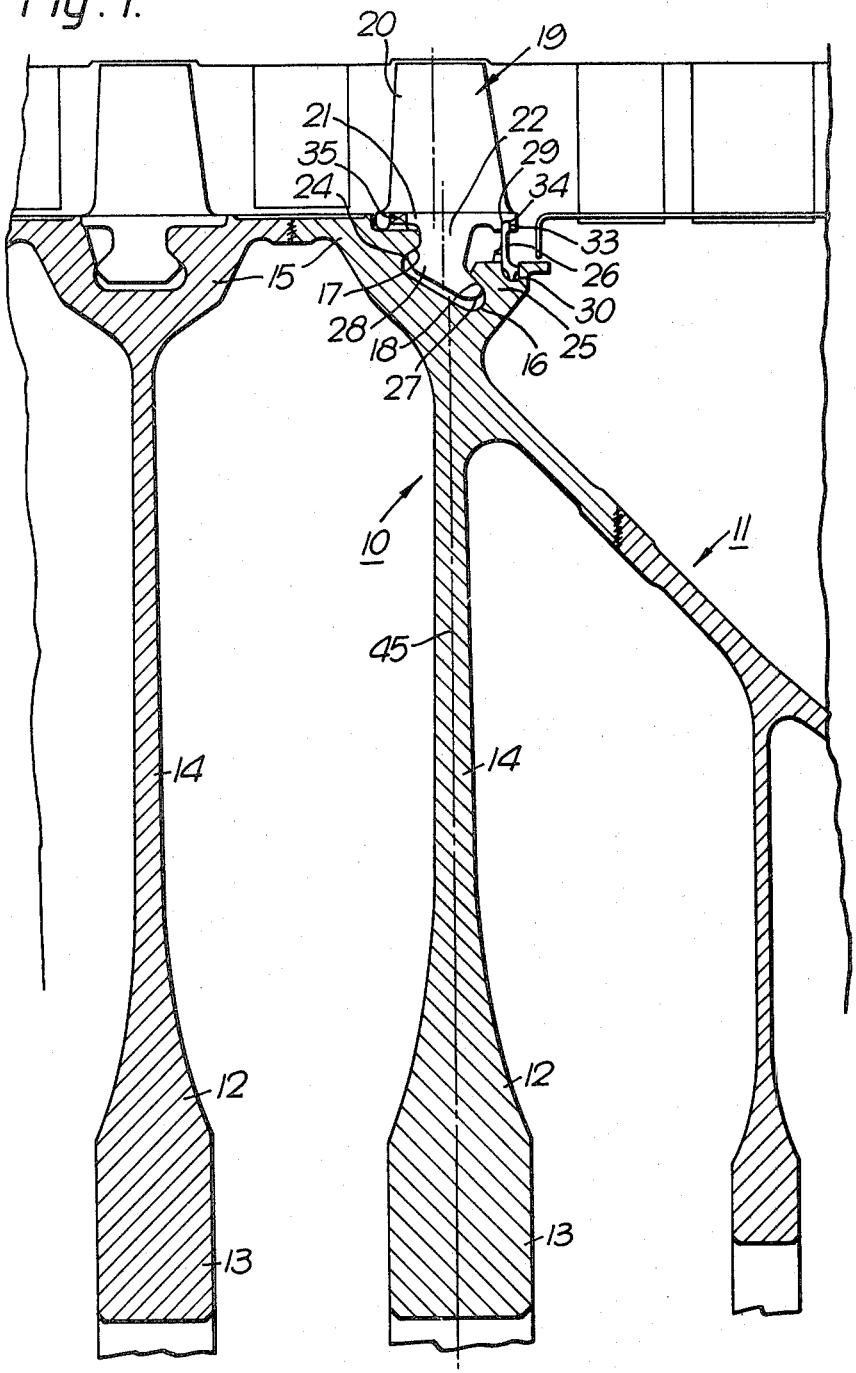
FIGS. 1 and 3 illustrate schematically radial cross-sectional views of part of two alternative designs of compressors for a gas turbine aero-engine incorporating the present invention.
Figure 2:
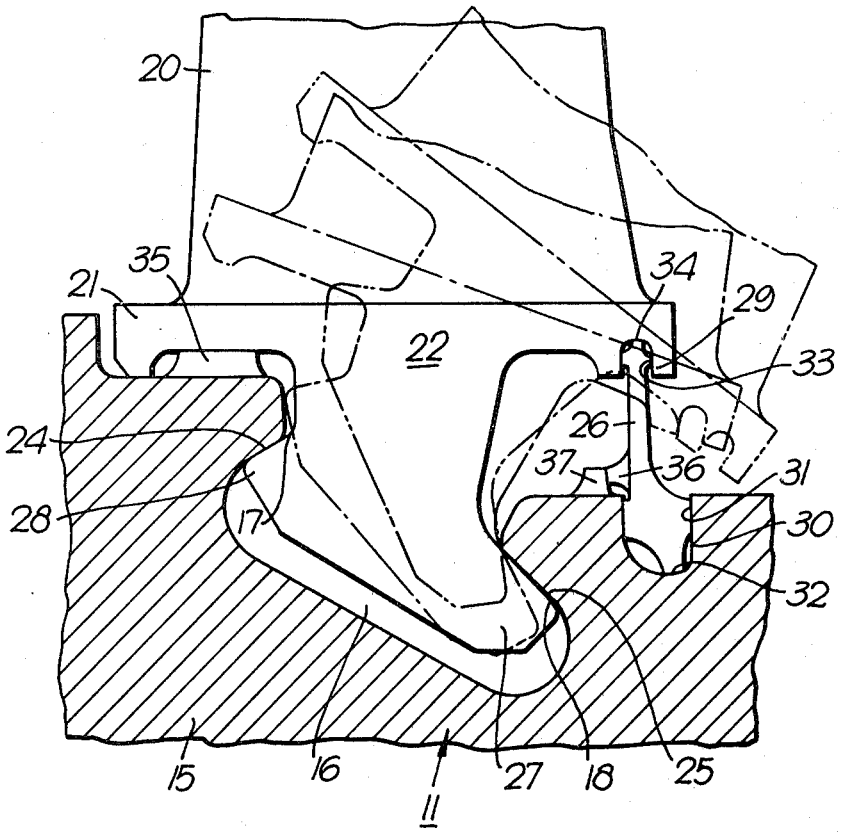
FIG. 2 illustrates the sequence of loading the final compressor stage blades into the circumferentially extending blade retention slot in the hub of the compressor of FIG. 1.

Referring to FIGS. 1 and 2 there is shown a part of the high pressure compressor rotor assembly 10 of a gas turbine aero engine, in which the final stage of the compressor incorporates the present invention.

The hub 11 comprises a plurality of annular compressor discs 12 each having a central cob 13, a radial flange 14 and a rim 15. The rims 15 of adjacent discs 12 are welded together to form a unitary multi-stage compressor rotor hub 11.

The final stage of the compressor is provided with a circumferentially extending dovetail blade-retaining slot 16 which has two radially inward facing surfaces 17,18 against which the centrifugal and gas loads on the blades 19 are reacted. The surfaces 17,18 are angled relative to the radial plane 45 which extends through the flange 14 so that the reaction forces intersect at a point radially in line with the centre of gravity of each blade 19.

The blades 19 have an aerofoil shaped portion 20, a platform 21 and a dovetail root 22. The dovetail root 22 has two radially outward facing surfaces 24,25 of complementary angles to that of the surfaces 17,18 and in use the surfaces 24,25 engage respectively the surfaces 17,18. A segmented seal plate 26 is provided to support the blades so that the root engages the surfaces 17,18 and holds the blades 19 in a central position. The root 22 has one of its flanks 27 (toe portion) longer than the other 28, (heel portion) and when the blade is positioned centrally in the blade-retaining slot 16, the centre-line of the blade is offset from the stacking line of the blade in order to bring the centre-line of the root 22 closer to the line of action of the centrifugal loads on the root 22.

The blade retaining slot 16 like the root 22 is not symmetric about the plane 45; it has a longer cavity (measured from plane 45) to accommodate the longer flank 27 and to facilitate loading of the blades 19 into the slot 16, than the length of cavity to accommodate the flank 28. The slot 16 is profiled to be deeper than the thickness of the portion of the root 22 that is radially inboard of the surfaces 24,25 and the dimensions of the narrowest and widest parts of the slot 16, and the dimensions of the widest and narrowest parts of the root 22 are so constructed and arranged relative to each other to enable the blades to be loaded as shown in FIG. 2.

Referring to FIG. 2, the nose of the longer flank 27 is inserted into the longer cavity from the rear of the compressor, and the nose of the other flank 28 is eased past the opposite side of the narrowest part of the slot 16 by rolling the tip of each blade forwards. All the blades 19 are loaded this way and each blade 19 is pulled radially outwards to bring the surfaces 24,25 of the flanks 27,28 respectively into contact with the surfaces 17,18 of the slot 16. After about half of the blades have been loaded a segment of the seal plate 26 is then inserted into a recess 29 on the underside of the platforms 21 of the blades 19 and in a circumferential recess 30 in part of the rim of the hub 11 and rotated to hold the blades. Further segments are positioned in the recess 29, and 30 and the remaining blades loaded by shuffling them around the slot onto the other segments. Finally, a slightly modified segment is inserted to hold the other segments and the complete set of blades in position. Each segment is provided with sealing surfaces 31,32 which engage with the side and bottom surfaces of the recess 30 and with seal surfaces 33,34, which engage the side and bottom surfaces of the recess 29. In addition, the joint between adjacent segments of the seal plate 26 are overlapped to provide air seals and the front edges of the platforms 21 co-operate with the rim 15 to form an effective air seal. In this way air leakage under tha blade platforms 21 can be reduced.

To prevent the blades 19 rotating around the slot 16 the front edge of the platforms of one or more of the blades 19 may be cut away to form a recess which engages a dog 35 which stands proud of a recess in the rim 15 which accommodates the platforms 21. Similarly the segments of the plate 26 are prevented from rotating in the recesses 29 and 30 by the provision of lugs 36 on the segments which engage similar lugs 37 on the rim 15, or the blades 19.

Figure 3:
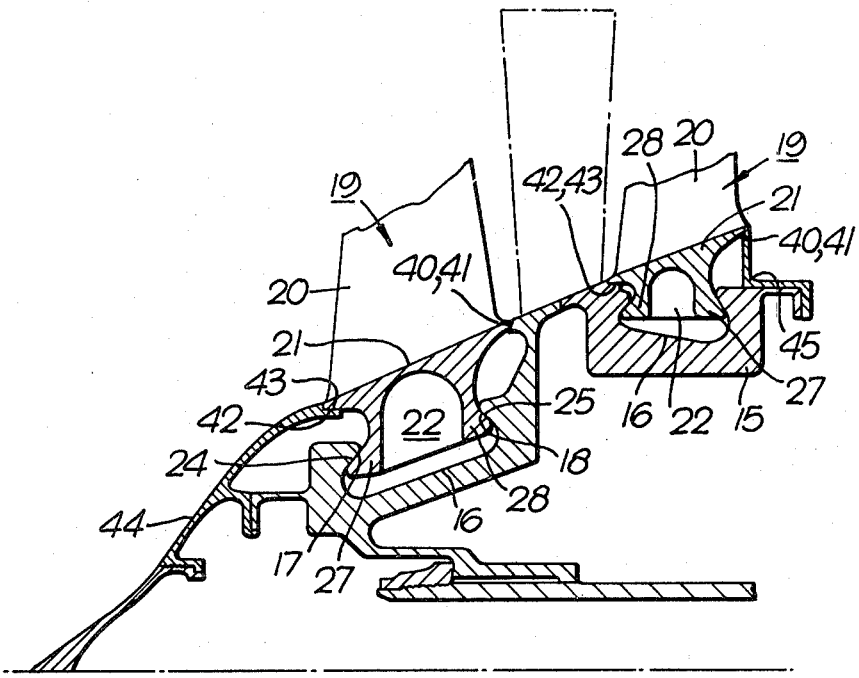

Referring now to FIG. 3 there is shown part of a low pressure compressor of a bypass type gas turbine aero engine having two compressor stages each of which incorporates the present invention. For the sake of clarity, features which are similar to those described in connection with FIGS. 1 and 2 are given the same reference numerals as in FIG. 1. The main differences over the embodiment shown in FIGS. 1 and 2 resides in the means of supporting the blades 19 in their respective blade-retaining slots 16, and the direction of loading the blades 19 into their slots 16.

The first stage row of blades 19 are loaded from the front by inserting the front flank into the widest part of the cavity of slot 16 and tilting the blades 19 rearwards. Instead of using a segmented seal plate to hold the blades into position with their surfaces 24,25 engaging the surfaces 17,18, the blades 19 are supported by the blade platforms 21.

The rear circumferentially extending edge of each blade platform 21 is chamfered to provide an inclined surface 40 which faces radially inwards. The surfaces 40 engage a complementary inclined surface 41 provided on an extension of the rim 15 which faces outwards. Each platform 21 has an inwardly facing surface 43 at its front edge which engages an outwardly facing surface 42 the rear perimeter edge of a detachable nose bullet 44. The nose bullet 44 is bolted to the rim 15 and holds the blade platforms 21 in contact with the surfaces 41,42.

Rotation of the first stage blades 19 around the slot 16 may be prevented either by the frictional engagement of the platform edges with the nose bullet 44 and the rim 15 or by providing mating splines (or recesses and dogs between the blade platforms 21 and the rim 15 or between the blade platforms 21 and the nose bullet 44, or by providing a small protrusion at the bottom of the slot with which a protrusion on a root of at least one of the blades co-operates.

Referring now to the second stage row of blades 19, here again the blades are supported in the slot 16 by means of the platforms 21, but the blades 19 are loaded into the slot 16 from the rear of the compressor. In this case however, the front edges of the platforms 21 have inwardly facing surfaces which engage outwardly facing surfaces of a recess provided in the rim 15 of the hub 11, and the rear edges of the platforms 21 have inclined surfaces facing radially inwards which engage an inclined surface on a detachable flange 45 which is bolted to the rim 15.

It will be seen that the shape of the dovetail form of the roots 22 of the blades 19 do not have such a pronounced difference in the lengths of the flanks 27,28. Nevertheless, the dimensions of the narrow and wide parts of each dovetail slot 16 in relation to the narrow and wide parts of the respective roots 22 of the blades are constructed and arranged relative to each other to permit the blades to be loaded into the slots by introducing one flank and rolling each blade in an axial direction.

If desired, the slots 16 may be symmetrical providing they are so dimensioned to have at least one axial extremity of the wide part of the slot deep enough to enable the flanks of the dovetail roots to be introduced as described above.

It is also possible to make the root dovetails symmetrical providing the amount of overlap of the flanks 27,28 and the surfaces 17,18 is sufficient to retain the blades when they are aligned radially in the slots 16.

I claim:

1. A bladed rotor assembly for a turbomachine comprising a hub having a dovetail shaped, circumferentially extending blade retaining slot, and a plurality of aerofoil shaped blades having dovetail shaped roots, each root having a toe portion and a heel portion, said roots being mounted in the blade retaining slot, the blade retaining slot having a radial cross-sectional shape dimensioned, constructed and arranged to permit the toe portion of the dovetail shaped roots to be first inserted into a corresponding toe portion of the blade retaining slot, and a heel portion of the dovetail shaped roots to be subsequently inserted into a corresponding heel portion of the blade retaining slot, thereby radially aligning the blade root portion in the dovetail shaped slot; and a blade root platform located between the dovetail shaped roots and the aerofoil shaped blades and provided with support means for radially outwardly torquing the blade root platform.

2. The bladed rotor assembly according to claim 1, wherein the blade root platform comprises two circumferentially extending edges having radially inwardly facing surfaces contacting radially outwardly facing surfaces of first and second radial extensions of the hub, said second radial extensions comprising said support means.

3. The bladed rotor assembly according to claim 2, wherein one of said two circumferentially extending edges of the platform contacts said first radial extension of the hub, said first radial extension being integral with the hub, and the other circumferentially extending edge of the platform contacts said second radial extension of the hub, said second radial extension being detachable from the hub.

4. The bladed rotor assembly according to claim 3, wherein the detachable extension comprises a segmented plate, a radially outwardly facing portion of the plate contacting a recess in one of the radially inwardly facing surfaces of the blade root platform and a radially inwardly facing portion of the segmented plate contacting a recess in a radially outwardly facing portion of the hub.

5. The bladed rotor assembly of claim 1, wherein one or more of the blades is provided with a means for engaging a feature of the hub to prevent the blades from traveling around the hub within the blade retaining slot.

6. The bladed rotor assembly of claim 5, wherein one or more of the blades is provided with splines which engage complementary shaped splines provided on the hub, thereby preventing the blades from traveling around the hub within the blade retaining slot.

7. The bladed rotor assembly of claim 1, wherein the hub is a compressor hub and surfaces of the toe and heel portions of the dovetail shaped blade retaining slot face radially inwardly and are angled relative to a radial plane, and engage respective radially outwardly facing surfaces of the toe and heel portions of the dovetail shaped root upon said insertion.

8. The bladed rotor assembly of claim 1, wherein center lines of the radial cross-sectional shape of the blade roots are offset from stacking lines of the blades.

9. A bladed rotor assembly for a turbomachine comprising a hub having a dovetail shaped, circumferentially extending blade retaining slot, and a plurality of aerofoil shaped blades having dovetail shaped roots, each root having a toe portion and a heel portion, mounted in the blade retaining slot, the blade retaining slot having a radial cross-sectional shape dimensioned, constructed and arranged to permit the toe portion of the dovetail shaped roots to be first inserted into corresponding toe portion of the blade retaining slot, and a heel portion of the dovetail shaped roots to be subsequently inserted into a corresponding heel portion of the blade retaining slot, thereby radially aligning the blade root portion in the dovetail shaped slot; the dovetail shaped blade retaining slot having a radially inwardly facing toe and heel surface angled relative to a radial plane, which engage respectively radially outwardly facing surfaces of said toe and heel portions of the dovetail shaped roots; and a blade root platform located between the dovetail shaped roots and the aerofoil shaped blades and provided with a support means for radially outwardly torquing the blade root platform.

10. The bladed rotor assembly of claim 9, wherein the blade root platform comprises two circumferentially extending edges having radially inwardly facing surfaces contacting radially outwardly facing surfaces of first and second radial extensions of the hub, said second radial extensions comprising said support means.

11. The bladed rotor assembly of claim 10, wherein one of said two circumferentially extending edges of the platform contacts said first radial extension of the hub, said first radial extension being integral with the hub, and the other circumferentially extending edge of the platform contacts said second radial extension of the hub, said second radial extension being detachable from the hub.

12. The bladed rotor assembly of claim 11, wherein the detachable extension comprises a segmented plate, a radially outwardly facing portion of the plate contacting a recess in one of the radially inwardly facing surface of the blade root platform and a radially inwardly facing portion of the segmented plate contacting a recess in a radially outwardly facing portion of the hub.

13. The bladed rotor assembly of claim 9, wherein one or more of the blades is provided with a means for engaging feature of the hub to prevent the blades from traveling around the hub within the blade retaining slot.

14. The bladed rotor assembly of claim 13, wherein one or more of the blades is provided with splines which engage complementary shaped splines provided on the hub, thereby preventing the blades from traveling around the hub within the blade retaining slot.

15. The bladed rotor assembly of claim 9, wherein center lines of the radial cross-sectional shape of the blade roots are offset from stacking lines of the blades.

16. A bladed rotor assembly for a turbomachine comprising a hub having a dovetail shaped, circumferentially extending blade retaining slot, and a plurality of aerofoil shaped blades having dovetail shaped roots, each root having a toe portion and a heel portion, said roots being mounted in the blade retaining slot, the blade retaining slot having a radial crosssectional shape dimensioned, constructed and arranged to permit the toe portion of the dovetail shaped roots to be first inserted into corresponding toe portion of the blade retaining slot, and a heel portion of the dovetail shaped roots to be subsequently inserted into a corresponding heel portion of the blade retaining slot, thereby radially aligning the blade root portion in the dovetail shaped slot; center lines of the radial cross-sectional shape of the blade roots being offset from stacking lines of the blades; and a blade root platform located between the dovetail shaped roots and the aerofoil shaped blades and provided with a support means for radially outwardly torquing the blade root platform.

17. The bladed rotor assembly of claim 16, wherein the blade root platform comprises two circumferentially extending edges having radially inwardly facing surfaces contacting radially outwardly facing surfaces of first and second radial extensions of the hub, said second radial extensions comprising said support means.

18. The bladed rotor assembly of claim 17, wherein one of said two circumferentially extending edges of the platform contacts said first radial extension of the hub, said first radial extension being integral with the hub, and the other circumferentially extending edge of the platform contacts said second radial extension of the hub, said second radial extension being detachable from the hub.

19. The bladed rotor assembly of claim 18, wherein the detachable extension comprises a segmented plate, a radially outwardly facing portion of the plate contacting a recess in one of the radially inwardly facing surfaces of the blade root platform and a radially inwardly facing portion of the segmented plate contacting a recess in a radially outwardly facing portion of the hub.

20. The bladed rotor assembly of claim 16, wherein one or more of the blades is provided with a means for engaging a feature of the hub to prevent the blades from traveling around the hub within the blade retaining slot.

21. The bladed rotor assembly of claim 20, wherein one or more of the blades is provided with splines which engage complementary shaped splines provided on the hub, thereby preventing the blades from traveling around the hub within the blade retaining slot.

22. The bladed rotor assembly of claim 16, wherein the hub is a compressor hub and surfaces of the toe and heel portions of the dovetail shaped blade retaining slot face radially inwardly and are angled relative to a radial plane, and engage respective radially outwardly facing surfaces of the toe and heel portions of the dovetail shaped root upon said insertion.

* * * * *